US012557931B1

(12) United States Patent
Roche

(10) Patent No.: US 12,557,931 B1
(45) Date of Patent: Feb. 24, 2026

(54) WINDOW TREATMENT ATTACHMENT SYSTEM AND METHOD

(71) Applicant: Reel Curtains LLC, Miami, FL (US)

(72) Inventor: Ekaterina Roche, Miami, FL (US)

(73) Assignee: Reel Curtains LLC, Miami, FL (US)

( * ) Notice: Subject to any disclaimer, the term of this patent is extended or adjusted under 35 U.S.C. 154(b) by 0 days.

(21) Appl. No.: 19/086,962

(22) Filed: Mar. 21, 2025

(51) Int. Cl.
*A47H 13/04* (2006.01)

(52) U.S. Cl.
CPC ..... *A47H 13/04* (2013.01); *A47H 2201/02* (2013.01)

(58) Field of Classification Search
CPC ..... A47H 2/00; A47H 13/04; A47H 2201/00; A47H 2201/02; A47H 23/04; A47H 2023/003; A47H 23/02; A47H 23/08; A47H 23/00; E06B 9/24
See application file for complete search history.

(56) References Cited

U.S. PATENT DOCUMENTS 4,106,741 A 8/1978 Hogg
4,333,187 A 6/1982 Schuler
5,146,972 A * 9/1992 Tacchella ..... A47H 19/00 160/349.2
5,205,337 A * 4/1993 Bozzo ..... A47H 13/00 160/84.01
5,409,189 A 4/1995 Lihmann
5,509,713 A * 4/1996 Hou ..... B60J 1/2011 160/370.21
5,604,961 A * 2/1997 Cole ..... B65D 63/10 24/442
6,219,892 B1 * 4/2001 Johnsen ..... A47H 13/00 24/706.1
6,279,804 B1 * 8/2001 Gregg ..... A45F 5/02 224/675
6,676,093 B2 1/2004 Franck et al.
7,845,387 B2 * 12/2010 Roberts ..... A47H 23/08 160/237
9,016,349 B2 * 4/2015 Seitz ..... A47H 13/00 160/179
11,046,556 B2 * 6/2021 Miller ..... B66B 11/0253
12,207,752 B1 * 1/2025 LeCompte ..... A44B 17/0041
2002/0035769 A1 * 3/2002 Huang ..... A47H 13/04 24/716
2003/0116287 A1 * 6/2003 Titus ..... A47H 5/14 160/348

(Continued)

*Primary Examiner* — Abe Massad
(74) *Attorney, Agent, or Firm* — Mark Terry

(57) ABSTRACT

A window treatment attachment system includes a first elongated strip configured to be attached to a ceiling in front of a window, the first elongated strip having a length substantially equal to a width of the window, and having an outward-facing surface of fastener material, a second elongated strip having a first layer of curtain tape having a plurality of pockets configured to receive curtain hooks, a second layer of fastener material secured to the first layer, and an intermediate fabric layer disposed between the first and second layers that extends beyond each end of the second elongated strip, forming graspable tabs, wherein the second elongated strip is removably attachable to the first elongated strip by mating engagement, and, wherein the curtain hooks are configured to engage the curtain tape of the second elongated strip and the curtain tape secured to a curtain, thereby suspending the curtain.

9 Claims, 12 Drawing Sheets

(56) References Cited

U.S. PATENT DOCUMENTS

| | | | | |
|---|---|---|---|---|
| 2004/0221540 | A1* | 11/2004 | Simons | A47H 23/02 52/311.1 |
| 2005/0011618 | A1* | 1/2005 | Kee | A47G 9/0284 160/179 |
| 2007/0074830 | A1* | 4/2007 | Osmond | A47H 21/00 160/330 |
| 2008/0203266 | A1 | 8/2008 | Gallien | |
| 2008/0283202 | A1* | 11/2008 | Serio, III | A47H 1/06 29/700 |
| 2010/0051214 | A1* | 3/2010 | Daly | A44B 19/262 160/368.1 |
| 2011/0168340 | A1* | 7/2011 | Squillante | A47H 2/00 160/368.1 |
| 2011/0174940 | A1 | 7/2011 | Cai | |
| 2023/0017213 | A1* | 1/2023 | Shorten | C08L 67/04 |
| 2025/0134215 | A1* | 5/2025 | LeCompte | A44B 17/0047 |

* cited by examiner

WINDOW TREATMENT ATTACHMENT SYSTEM AND METHOD

CROSS REFERENCE TO RELATED APPLICATIONS

Not applicable.

STATEMENT REGARDING FEDERALLY SPONSORED RESEARCH DEVELOPMENT

Not applicable.

INCORPORATION BY REFERENCE OF MATERIAL SUBMITTED ON A COMPACT DISC

Not applicable.

TECHNICAL FIELD

The technical field relates generally to home furnishings and more specifically to systems and methods for attachment of window treatments.

BACKGROUND

The attachment and installation of window treatments, such as curtains, drapes, and similar fabric coverings, traditionally require cumbersome hardware including rods, rails, tracks, brackets, hooks, or other mechanical supports. Existing curtain mounting systems typically necessitate drilling into walls or ceilings to secure rods and brackets, resulting in permanent holes or marks. Such installations often require multiple tools, hardware components, precise measurement, and professional skill, thereby making the process inconvenient, expensive, and potentially damaging to surfaces. In situations where the user is renting, he may be reluctant to drill into walls or take other actions that could cause damage, potentially resulting in the loss of his security deposit.

Conventional systems, particularly curtain rod arrangements, also frequently suffer from aesthetic drawbacks, with hardware remaining conspicuously visible, detracting from interior design objectives. Additionally, standard methods for hanging curtains involve difficult or repetitive procedures, such as manually aligning curtain hooks into pleated fabric headers or inserting hooks directly into fabric tape attached to the curtain's top portion. Adjusting or removing curtains using existing installations can also be challenging, often necessitating climbing on furniture or ladders, which poses inconvenience and safety risks, especially for elderly or physically impaired individuals.

Another common shortcoming of traditional curtain attachment approaches includes limited flexibility for cleaning, replacement, or seasonal changes. Users may find themselves reluctant to frequently remove or replace curtains due to the complexity, inconvenience, or risk of damage inherent in traditional attachment mechanisms. Moreover, existing systems often provide insufficient stability, causing curtains to sag, droop, or become misaligned over time, necessitating frequent readjustments.

Therefore, there remains a need in the art for a window treatment attachment system and method that addresses these limitations by providing an easier, safer, more aesthetically pleasing, and versatile solution for mounting and removing curtains without damaging surfaces or requiring complicated installation procedures.

SUMMARY

A window treatment attachment system and method is disclosed. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

The window treatment attachment system includes a first elongated strip configured to be attached to a ceiling in front of a window, the first elongated strip having a length substantially equal to a width of the window, and having an outward-facing surface comprising a fastener material, a second elongated strip comprising a first layer of curtain tape having a plurality of pockets configured to receive curtain hooks, a second layer of fastener material secured to the first layer, and an intermediate fabric layer disposed between the first and second layers, wherein the intermediate fabric layer extends beyond each end of the second elongated strip, forming graspable tabs, wherein the second elongated strip is removably attachable to the first elongated strip by mating engagement of the fastener material of the second elongated strip with the fastener material of the first elongated strip, and, wherein the curtain hooks, when disposed in the pockets of the curtain tape of the second elongated strip, are configured to engage curtain tape secured to a curtain, thereby suspending the curtain from the second elongated strip.

Further, a method of removably attaching a curtain to a ceiling adjacent a window, comprises providing a first elongated strip having a first fastener material disposed on an outward-facing side thereof, and securing the first elongated strip directly to a ceiling surface adjacent the window so as to extend substantially the width of the window, providing a second elongated strip comprising curtain tape with a plurality of pockets, an intermediate fabric layer, and a second fastener material, wherein the intermediate fabric layer is positioned between the curtain tape and the second fastener material and extends longitudinally beyond ends of the second elongated strip, forming graspable fabric tabs, inserting curtain hooks into pockets of the curtain tape of the second elongated strip such that portions of the curtain hooks protrude outwardly from the curtain tape, engaging the protruding portions of the curtain hooks with corresponding pockets formed in curtain tape attached to an upper portion of the curtain, removably securing the second elongated strip to the first elongated strip by pressing the first fastener material and the second fastener material into mating engagement, and, selectively detaching the second elongated strip and the curtain from the first elongated strip by pulling downwardly on at least one of the graspable fabric tabs, thereby disengaging the mating engagement of the first and second fastener materials.

Additional aspects of the disclosed embodiment will be set forth in part in the description which follows, and in part will be obvious from the description, or may be learned by practice of the disclosed embodiments. The aspects of the disclosed embodiments will be realized and attained by means of the elements and combinations particularly pointed out in the appended claims. It is to be understood that both the foregoing general description and the following detailed description are exemplary and explanatory only and are not restrictive of the disclosed embodiments, as claimed.

BRIEF DESCRIPTION OF THE DRAWINGS

The accompanying drawings, which are incorporated in and constitute part of this specification, illustrate embodiments of the invention and together with the description, serve to explain the principles of the disclosed embodiments. The embodiments illustrated herein are presently preferred, it being understood, however, that the invention is not limited to the precise arrangements and instrumentalities shown, wherein.

DETAILED DESCRIPTION

Figure 1:
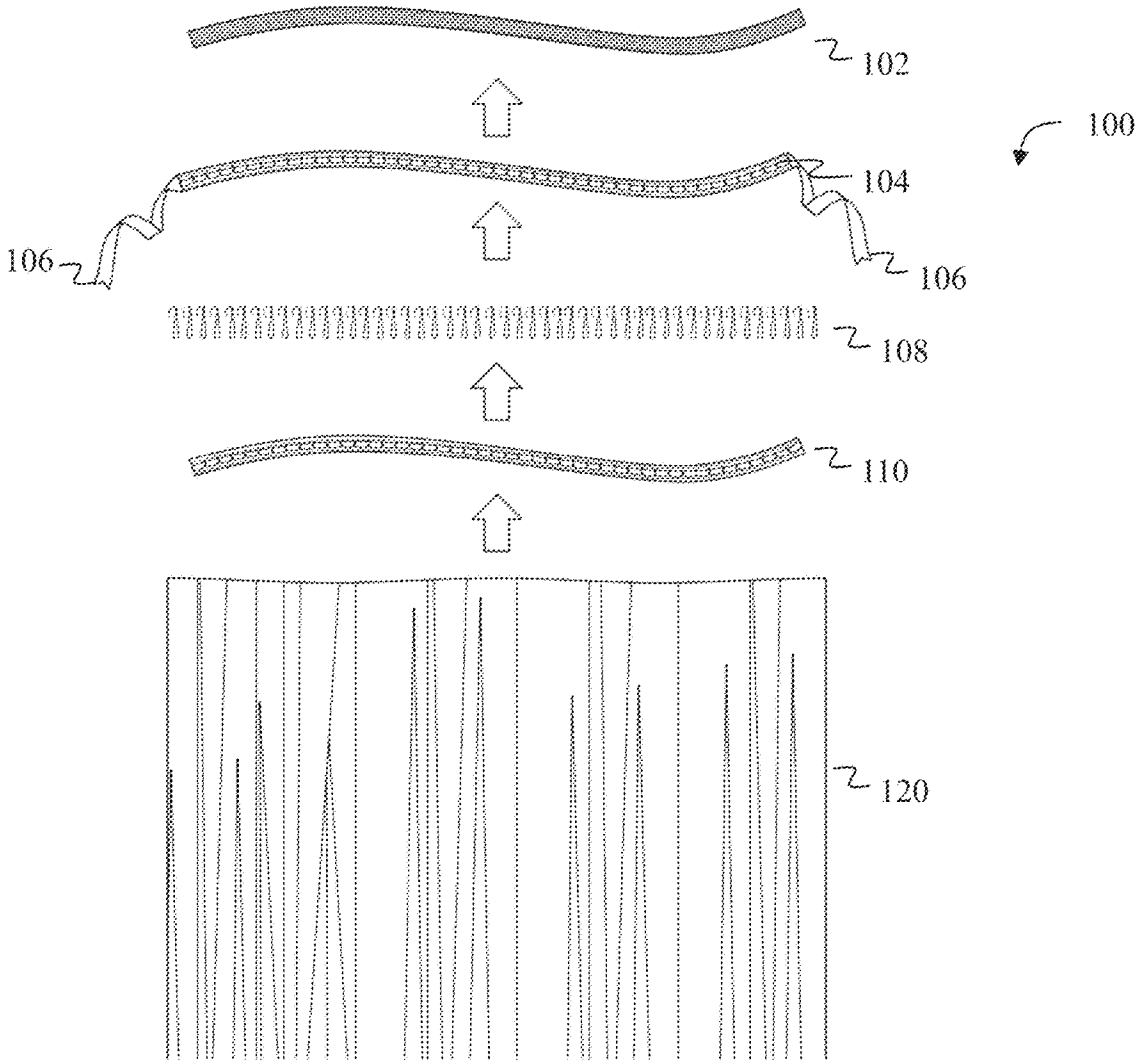
FIG. 1 illustrates the main components of the window treatment attachment system, according to an example embodiment.

The following detailed description refers to the accompanying drawings. Wherever possible, the same reference numbers are used in the drawings and the following description to refer to the same or similar elements. While embodiments may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the claimed subject matter. Instead, the proper scope of the claimed subject matter is defined by the appended claims.

The claimed embodiments provide significant improvements over the prior art curtain attachment systems by addressing numerous drawbacks associated with traditional hardware-based methods of installing curtains. Unlike conventional curtain rods, brackets, tracks, or similar installations, the inventive system eliminates the need to drill into walls or ceilings, thus preventing damage to surfaces and avoiding the loss of security deposits for renters. The inventive window treatment attachment system simplifies installation, allowing curtains to be mounted rapidly without specialized tools, precise measurements, or professional assistance, which contrasts with prior art approaches that are often cumbersome and require considerable time and skill.

Furthermore, unlike traditional rod-and-hook methods, the claimed embodiments enhance aesthetic appeal by concealing mounting hardware from view. The fastener materials employed enable the window treatment to hang seamlessly, producing a clean, finished appearance, free from the visually disruptive brackets and rods common in existing systems. Stability issues such as sagging, drooping, or misalignment frequently encountered in prior art systems are minimized or entirely avoided through secure engagement of the elongated fastener strips, maintaining alignment and preventing movement during normal use.

Moreover, conventional curtain attachment methods often require complex procedures to detach curtains for cleaning or replacement, creating inconvenience and safety hazards, especially when ladders or step stools are needed to access the mounting hardware. The inventive system greatly simplifies curtain removal. Users merely grasp and pull downward on the provided fabric tabs, conveniently disengaging the fastening materials and safely lowering the curtain, thereby significantly reducing the effort and risk involved with periodic maintenance or seasonal decoration changes. This feature is particularly advantageous for elderly or physically impaired users, who may find conventional curtain installations unsafe or impractical to operate regularly. Therefore, the disclosed curtain attachment system and method addresses and overcomes the longstanding limitations of the prior art by providing an easy-to-install, aesthetically appealing, safe, stable, and convenient solution for the attachment and removal of window treatments.

As used herein, window treatments are coverings for windows that serve both functional and aesthetic purposes. Window treatments include soft treatments, such as curtains, drapes and other fabric coverings, as well as hard treatments, such as blinds and shutters.

The claimed method and system for attaching curtains will now be described with reference to FIGS. 1 through 11. Referring now to FIG. 1, the main components of the window treatment attachment system 100 are illustrated, comprising a first elongated strip 102, a second elongated strip 104, graspable tabs 106, curtain hooks 108, curtain tape 110, and curtains 120. First elongated strip 102 is elongated, rigid or semi-rigid, and dimensioned substantially equal to or slightly greater than the width of the window with which it is used. It is typically manufactured from materials including plastic, extruded plastic, rigid polymeric composites, or synthetic fibers, and serves as the foundational support component for the entire system. Second elongated strip 104 is removably attachable to first elongated strip 102, providing support for curtains 120, and is composed of the same material as first elongated strip 102, in addition to flexible, layered fabric and fastening materials. Graspable tabs 106, which extend downward from each end of second elongated strip 104, enable manual grasping and facilitate the quick removal of second elongated strip 104 from first elongated strip 102 without requiring additional tools or ladders. Curtain hooks 108 protrude from second elongated strip 104 and securely engage corresponding curtain tape 110, thereby suspending curtains 120.

Figure 2:
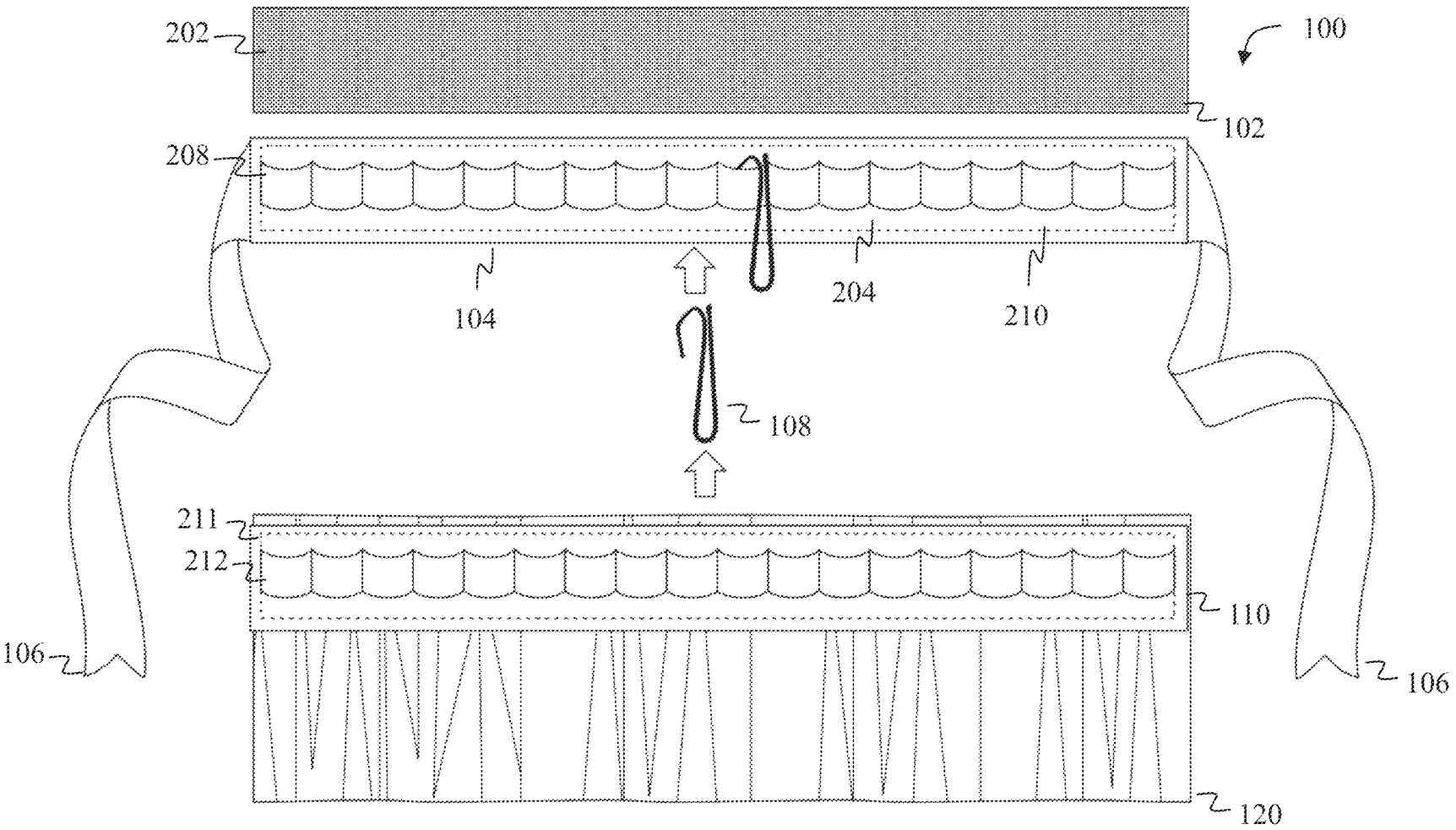
FIG. 2 illustrates a closeup of the components of the window treatment attachment system that attach the curtain to the ceiling, according to an example embodiment.

FIG. 2 illustrates in detail the components used to attach curtains 120 to first elongated strip 102. First elongated strip 102 has touch fastener material 202, such as hook-and-loop fabric, adhesively bonded or otherwise affixed along its outward-facing surface. Alternative materials for touch fastener material 202 include magnetic tape or snap-based fasteners. First elongated strip 102 may have adhesive affixed along its inward-facing surface (not shown), which is used to affix the strip to the ceiling.

Second elongated strip 104 comprises curtain tape 204 sewn with durable stitching 210 onto a second layer of touch fastener material, with an intermediate fabric layer positioned therebetween. Curtain tape 204 includes numerous pockets or loops 208 configured to securely receive curtain hooks 108, which may be constructed from plastic, metal, or any suitably rigid, durable material. Curtain tape 204 may be sewn onto the second layer and the intermediate fabric layer with stitching 210. Curtain tape 110 may be adhered or sewn onto curtains 120 with stitching 211, providing corresponding pockets or loops 212 configured to engage protruding curtain hooks 108 securely. Curtain tape 110 and curtain tape 204 may be made from woven polyester, nylon webbing, cotton-blend fabrics, or other robust and flexible textiles.

Figure 3:
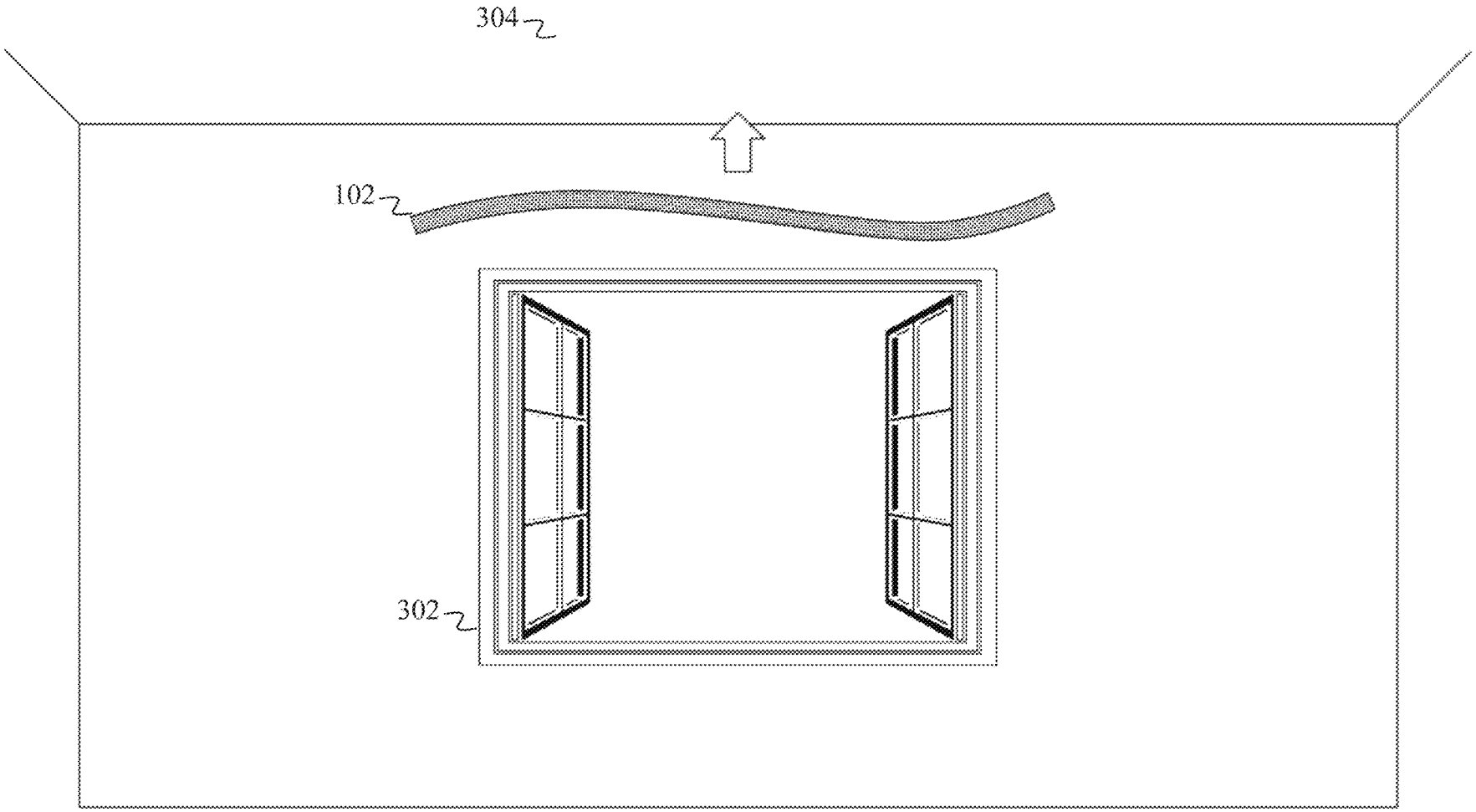
FIG. 3 illustrates the placement of the first elongated strip of the window treatment attachment system to the ceiling, according to an example embodiment.

Referring to FIG. 3, first elongated strip 102 is shown being mounted directly to ceiling 304 adjacent window 302. Ceiling 304 may be drywall, plaster, wood, concrete, or similar interior surface materials. First elongated strip 102 is secured to ceiling 304 using adhesive strips, liquid adhesive, screws, nails, or other suitable fastening means. Adhesive fastening is particularly preferred, eliminating the need for permanent drilling or screws, thus avoiding damage to ceiling surfaces.

Figure 4:
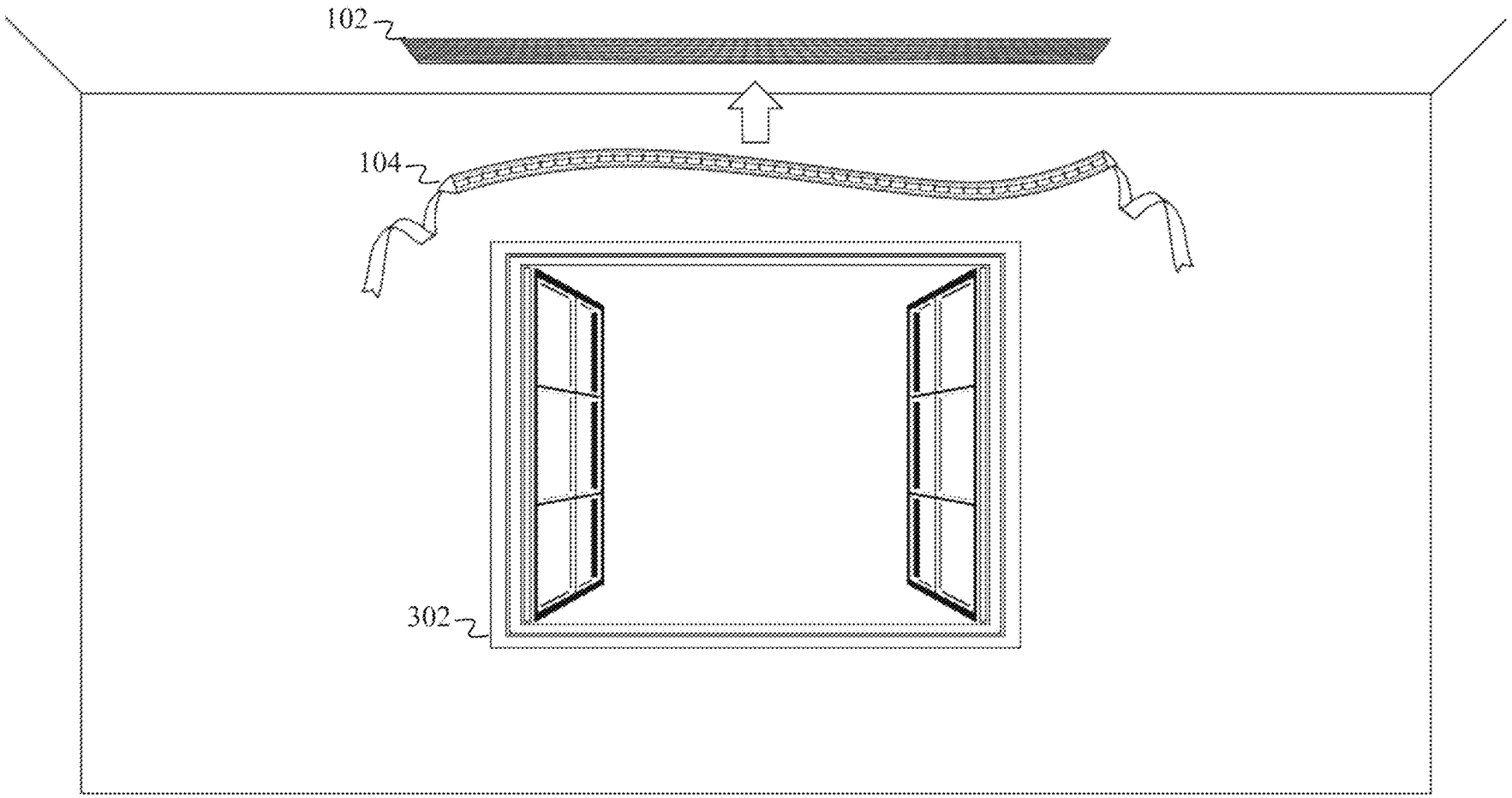
FIG. 4 illustrates the placement of the second elongated trip onto the first elongated strip of the window treatment attachment system, according to an example embodiment.

FIG. 4 depicts second elongated strip 104 as it is being placed into secure, removable engagement with first elongated strip 102, previously installed on ceiling 304 adjacent window 302. The mating engagement between first elongated strip 102 and second elongated strip 104 is achieved through attaching the touch fastener material of the first strip onto the touch fastener material of the second strip, allowing convenient yet secure attachment and detachment without tools.

Figure 5:
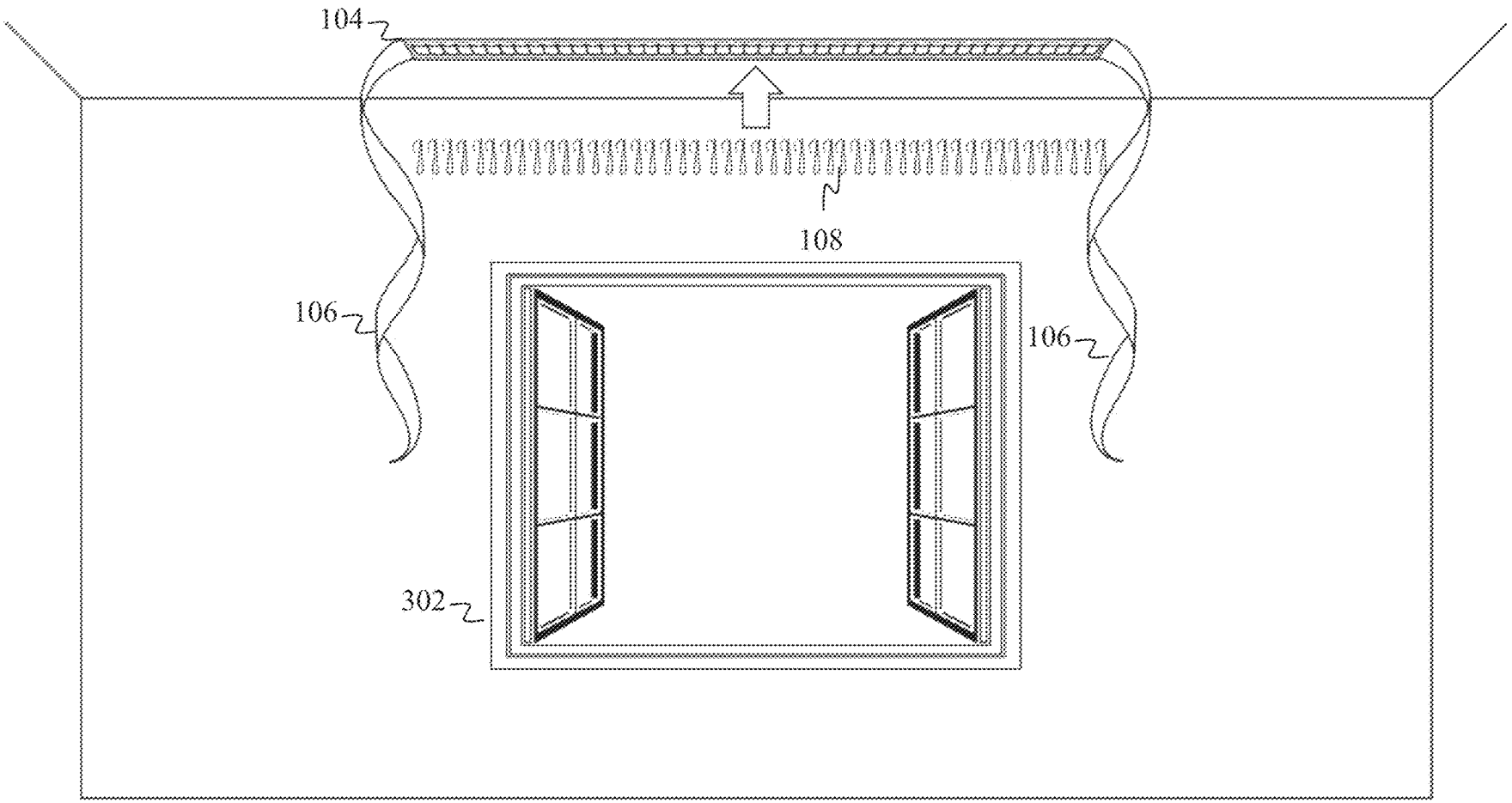
FIG. 5 illustrates the curtain hooks adjacent to the second elongated strip of the window treatment attachment system, according to an example embodiment.

FIG. 5 illustrates second elongated strip 104 with graspable tabs 106 extending downward from each end, and curtain hooks 108 adjacent thereto, ready for insertion. Graspable tabs 106 provide an ergonomic, safe means for users to manually remove second elongated strip 104 and attached curtains 120 from ceiling 304 by pulling downward, disengaging touch fastener material 202 from first elongated strip 102.

Figure 6:
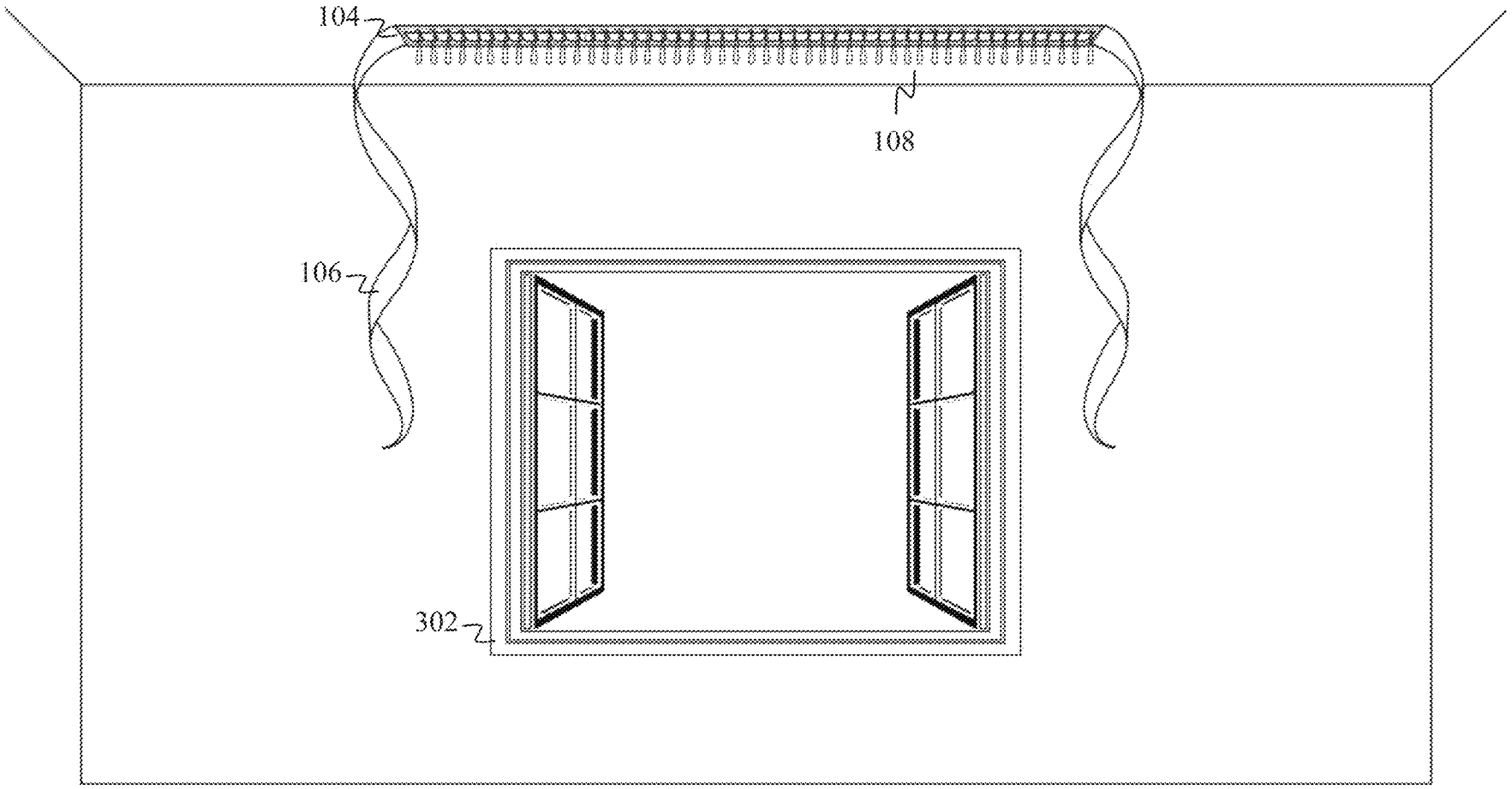
FIG. 6 illustrates the curtain hooks attached to the second elongated strip of the window treatment attachment system, thereby in a form ready for the attachment of the curtain, according to an example embodiment.

In FIG. 6, curtain hooks 108 have been inserted securely into pockets 208 of curtain tape on second elongated strip 104, preparing second elongated strip 104 for subsequent attachment of curtains 120. Curtain hooks 108 remain vertically oriented, projecting outwardly to securely engage the curtain tape on curtain 110 attached directly to curtains 120. Note that a curtain hook typically comprises two distinct U-shaped elements. The first U-shaped element is specifically designed for insertion into the pockets 208 of curtain tape on second elongated strip 104. The second U-shaped element, which extends oppositely from the first, is adapted for insertion into corresponding pockets 212 provided by the curtain tape 110 affixed directly onto the curtain itself. Each of these U-shaped elements is dimensioned and shaped to securely engage their respective curtain tape pockets, thereby maintaining stable attachment and proper alignment of the curtain relative to the supporting strip. Said hooks may be composed of metal, plastic, etc.

Figure 7:
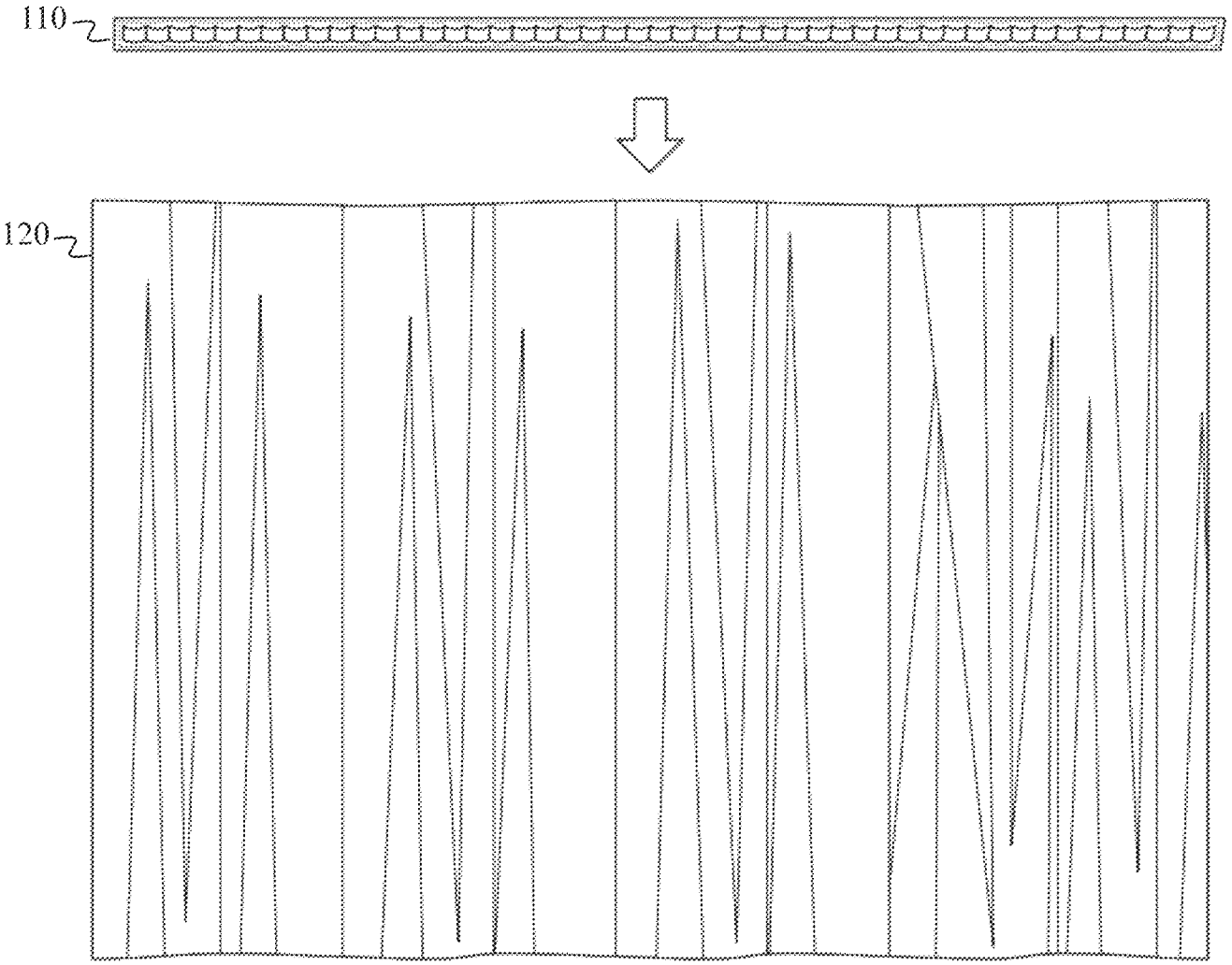
FIG. 7 illustrates the curtain tape adjacent to the curtains of the window treatment attachment system, according to an example embodiment.

FIG. 7 clearly shows curtain tape on curtain 110 adjacent to curtains 120 prior to installation. Curtain tape 110 is positioned near the upper edge of curtains 120, ready to be secured to the curtains, providing pockets 212 for attachment to curtain hooks 108. Curtain tape 110 can be manufactured from woven fabric materials such as cotton, polyester blends, nylon, or similar textiles. Curtain tape may include adhesive on a back surface for attachment to the curtains.

Figure 8:
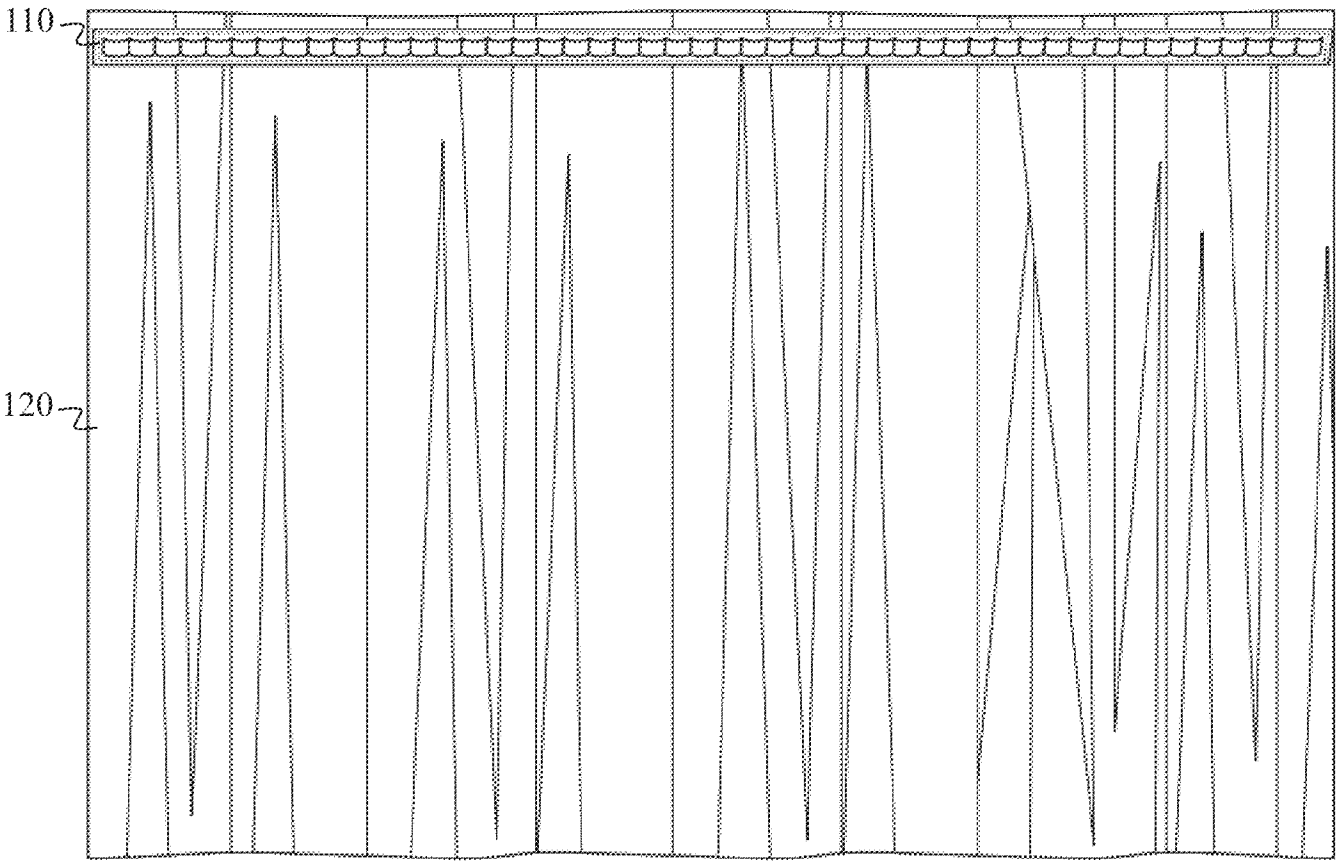
FIG. 8 illustrates the curtain tape attached or secured to the curtains of the window treatment attachment system, according to an example embodiment.

FIG. 8 illustrates curtain tape 110 after being securely attached to curtains 120. Once attached, curtain tape 110 is permanently or semi-permanently affixed to curtains 120, providing stable pockets 212 configured for receiving curtain hooks 108, allowing curtains 120 to be quickly and easily attached to second elongated strip 104.

Figure 9:
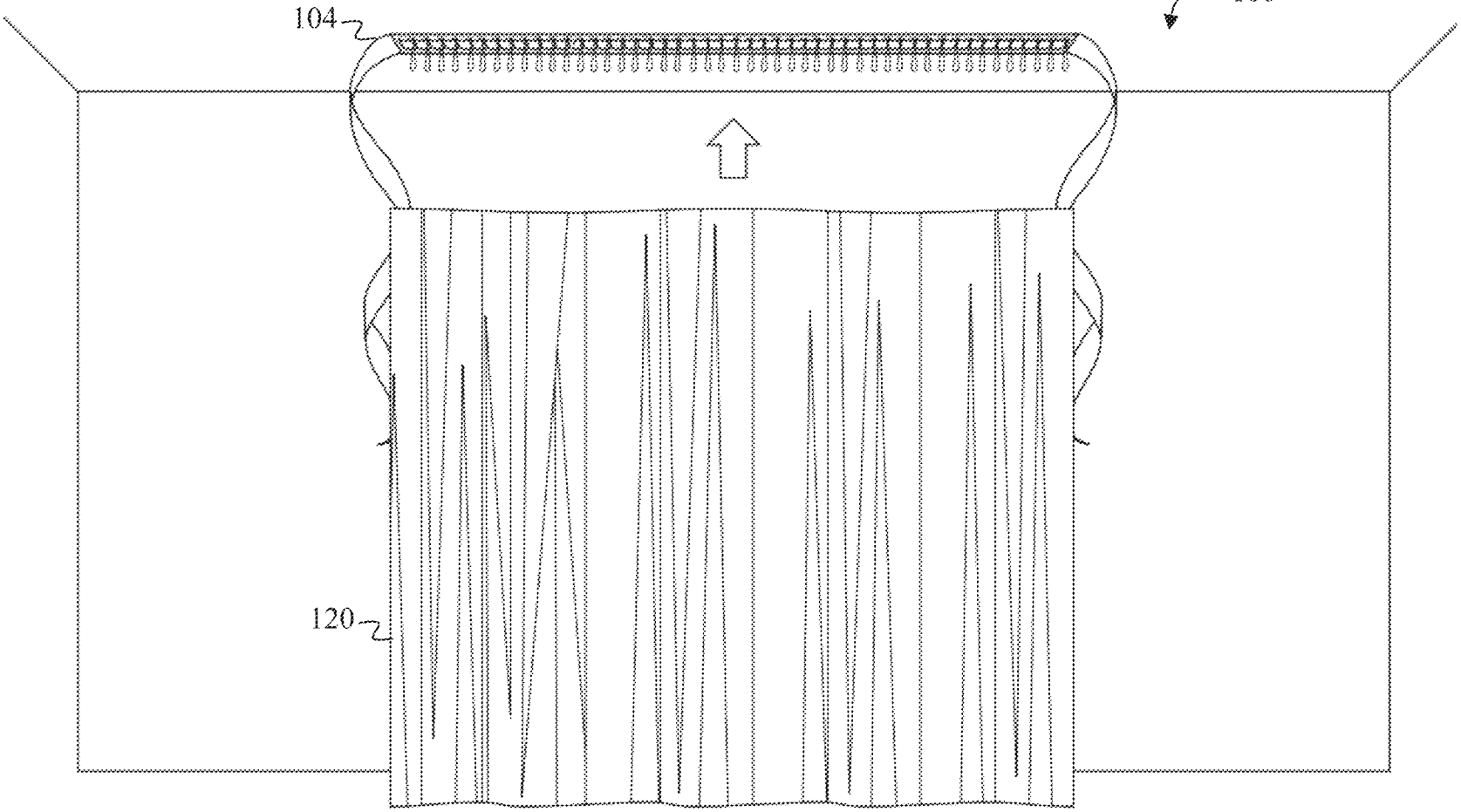
FIG. 9 illustrates the curtains being attached to the window treatment attachment system, according to an example embodiment.

FIG. 9 demonstrates the final step of installing curtains 120, whereby second elongated strip 104 is attached to ceiling 304 via first elongated strip 102 and carrying protruding curtain hooks 108. Second elongated strip 104 is positioned to engage curtain tape 110 attached to curtains 120. Curtains 120 are thus suspended neatly, evenly, and securely without additional hardware, eliminating common issues such as misalignment, sagging, or difficulty adjusting curtain position.

Figure 10:
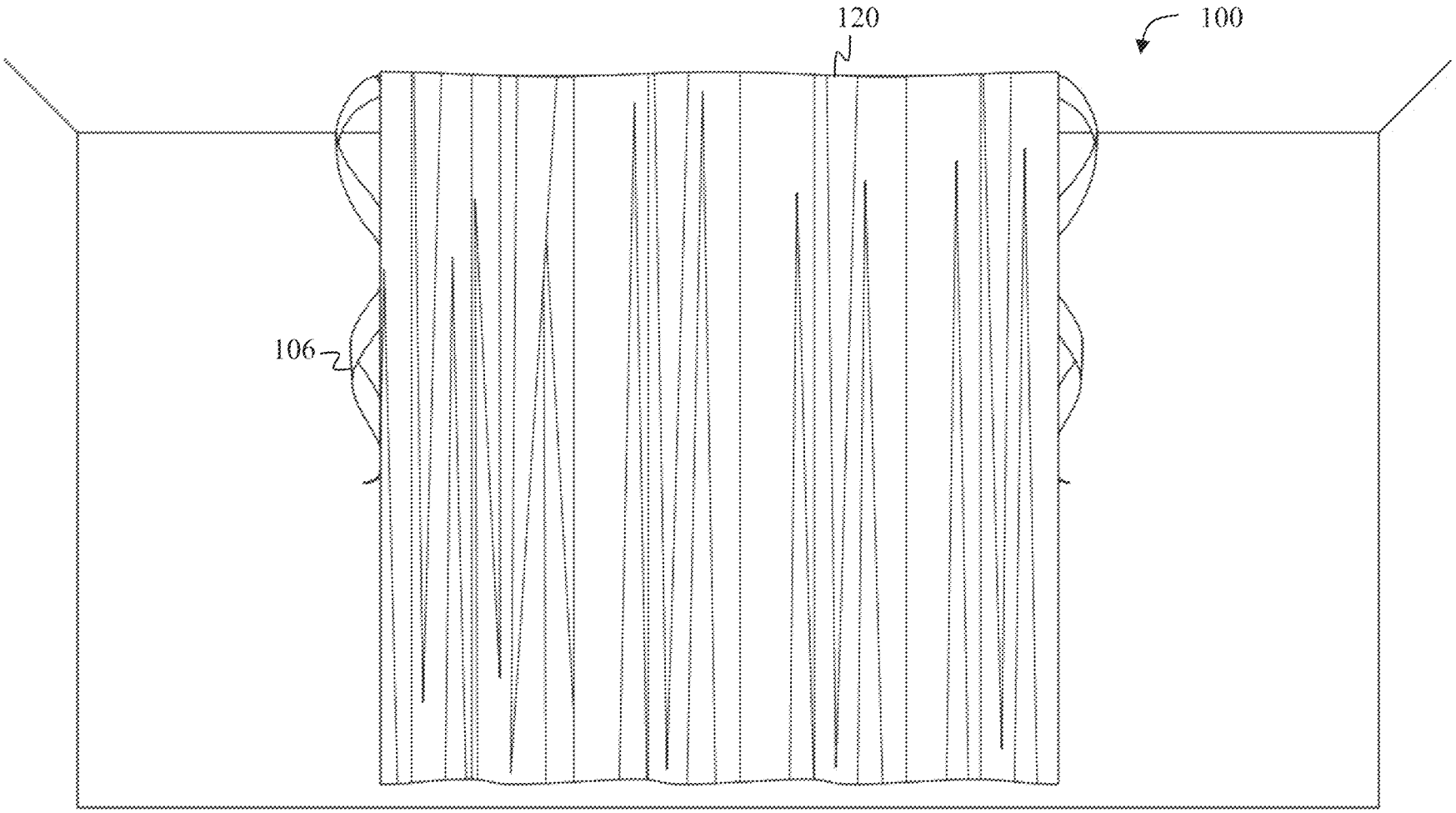
FIG. 10 illustrates a front view of the window treatment attachment system in fully assembled form, according to an example embodiment.

FIG. 10 provides a front view of the fully assembled window treatment attachment system 100. Curtains 120 hang aesthetically from ceiling 304 adjacent window 302, entirely concealing first elongated strip 102 and second elongated strip 104, as well as the window, from casual view. Only graspable tabs 106 are visible at either end, allowing users quick and convenient access to remove curtains 120 for cleaning or replacement by simply pulling downward, thereby disengaging touch fastener material 202 without the use of ladders, tools, or complicated procedures.

Figure 11:
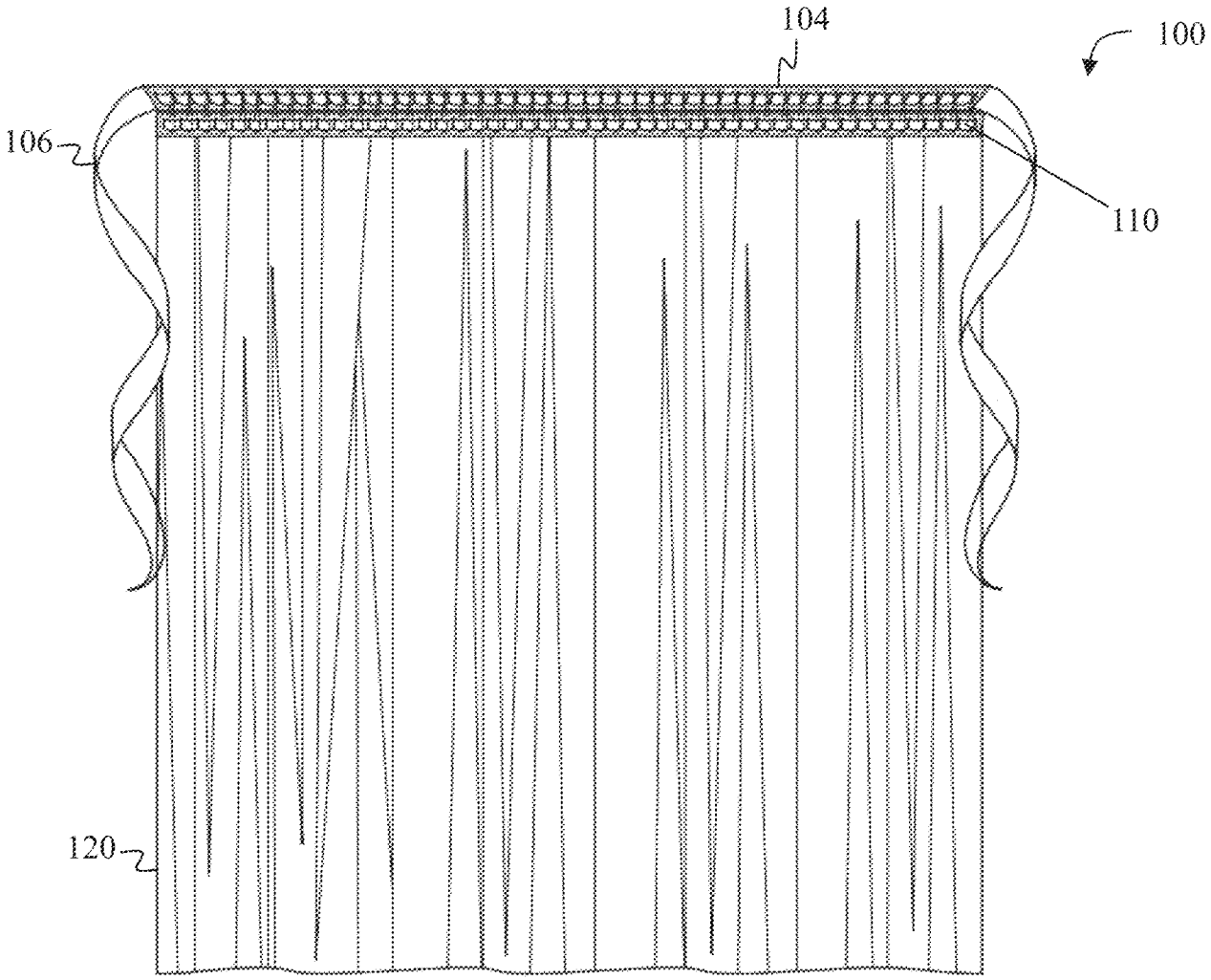
FIG. 11 illustrates a rear view of the window treatment attachment system in fully assembled form, according to an example embodiment.

FIG. 11 illustrates a rear view of the fully assembled window treatment attachment system 100, showing second elongated strip 104 attached to curtains 120 by means of curtain hooks 108 securely engaged with curtain tape 110 on the curtain. Graspable tabs 106 remain clearly visible and easily accessible, ensuring that users can safely and conveniently disengage second elongated strip 104 and curtains 120 from first elongated strip 102 at any time. The system is particularly advantageous for users with limited mobility, eliminating safety hazards and inconvenience common with traditional curtain attachment methods, while also preserving ceiling 304 and window 302 surfaces from damage.

Figure 12:
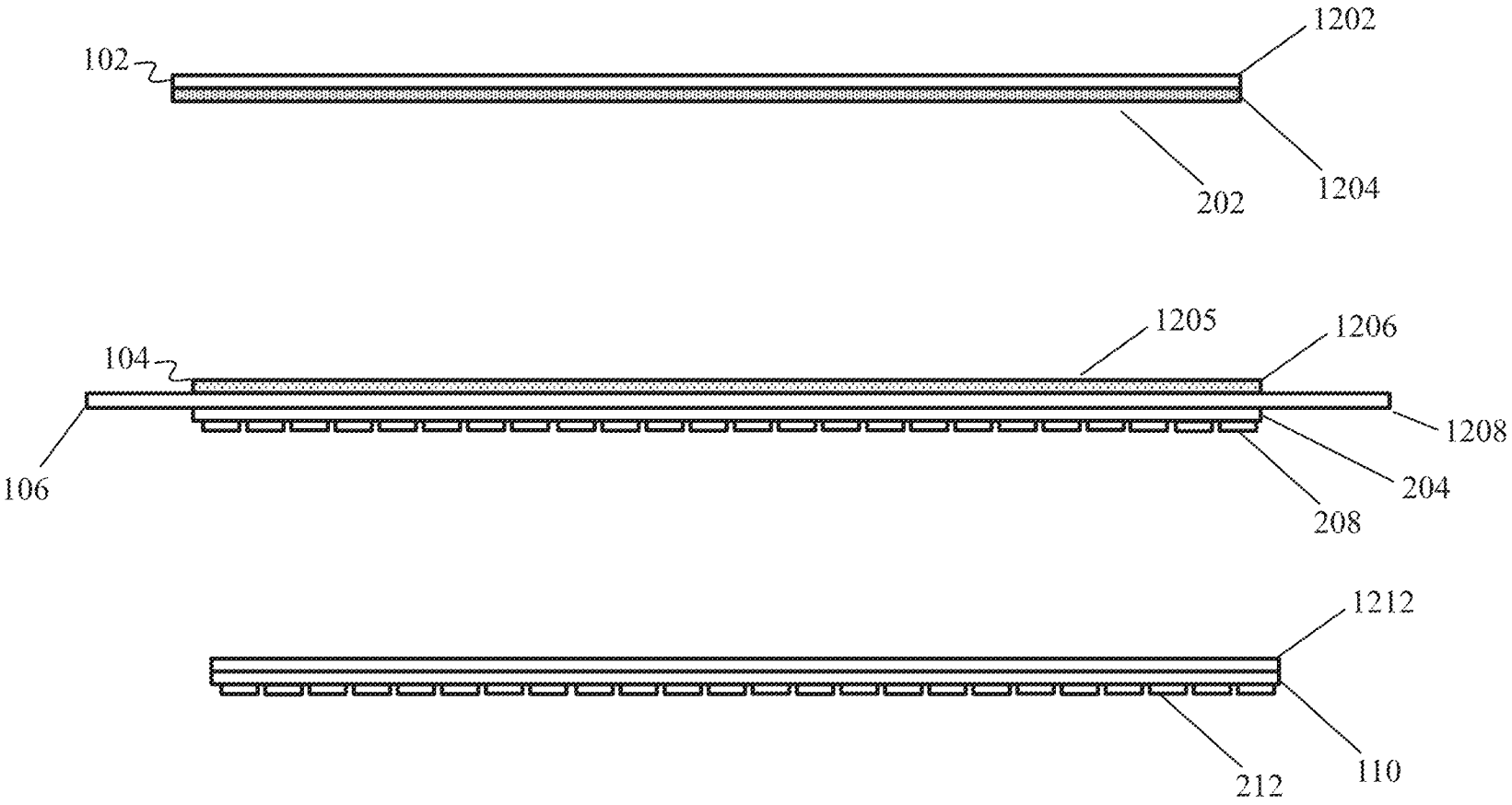
FIG. 12 illustrates the layers of various components of the window treatment attachment system, according to an example embodiment.

FIG. 12 illustrates the layers of various components of the window treatment attachment system 100, according to an example embodiment. FIG. 12 shows that first elongated strip 102 comprises a layer of touch fastener material 202 located on a strip of fabric like material 1204, on the rear of which is deposited a layer of adhesive material 1202, configured for attaching to the ceiling. FIG. 12 also shows that second elongated strip 104 comprises a layer of touch fastener material 1205 located on a strip of fabric like material 1206, wherein the first layer of touch fastener material 1205 is configured for removable attachment to the first layer of touch fastener material 202 on first elongated strip 102. Behind the layer of touch fastener material 1205 is a layer of fabric material 1208 that extends beyond the ends of the first layer of touch fastener material 1205, so as to make graspable tabs 106. Behind the layer of fabric material 1208 is a layer of curtain tape 204 having a plurality of pockets 208 configured to receive curtain hooks.

FIG. 12 also shows curtain tape 110 having a plurality of pockets 212 configured to receive curtain hooks. On the rear of the curtain tape is deposited a layer of adhesive material 1212, configured for attaching to the curtains.

As used herein, the term "curtain tape" refers broadly to fabric-based strips or bands attached to the upper portion of curtains, drapes, and similar window treatments, typically for facilitating attachment to mounting hardware such as curtain hooks. Curtain tape encompasses various types, each adapted for specific curtain styles, weights, and functional or decorative effects. For example, universal tape is commonly employed with lighter weight or shorter curtains, providing a straightforward attachment solution with minimal decorative effect. Gathering tape is designed for heavier curtains and creates a simple, uniform gathered effect across the top portion of the curtain. Pleating tape, available in various depths—most commonly 45 mm and 70 mm—is specifically configured to form decorative pleats, such as pencil pleats, box pleats, or pinch pleats, enhancing the aesthetic appearance of curtains and draperies. Multi-pocket tape provides multiple rows of vertically arranged pockets, allowing users to adjust the effective height of the curtain easily by selecting different pockets into which curtain hooks are inserted. Pelform and buckram tapes contain embedded stiffening materials to provide structure and rigidity to the curtain header, resulting in a crisp, defined finish that maintains its shape. In addition, holdbacks, often utilized in conjunction with curtain tape systems, are decorative accessories designed to hold curtains open or back in a stylish manner; holdbacks may be fabricated from metal, wood, fabric, or other suitable materials, complementing the aesthetic presentation of window treatments.

As used herein, the term "touch fastener material" broadly refers to various forms of releasably engaging fastening systems that securely mate upon contact and are disengaged by pulling apart the joined surfaces. Touch fastener materials specifically include traditional hook-and-loop fastening fabrics, such as those sold under the VELCRO® brand, wherein one surface includes numerous small hooks and the mating surface includes loops of fabric that become entangled when pressed together, providing secure yet easily releasable attachment. The term also encompasses heavy-duty variants of touch fasteners, including mushroom-type or stem-type fasteners such as 3M™ Dual Lock™ or Duotec®, characterized by rigid mushroom-shaped stems or projections positioned on each mating surface. When pressed together, these mushroom-shaped stems interlock securely and provide a tactile and audible "snap" indicating positive engagement. Such heavy-duty mushroom-type fasteners provide greater holding strength, shear resistance, and durability than standard hook-and-loop fasteners, making them suitable for applications requiring enhanced stability, repeated engagement and disengagement cycles, and reliable attachment under varying load conditions.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

I claim:

1. A window treatment attachment system, comprising:

a first elongated strip configured to be attached to a ceiling in front of a window, the first elongated strip having a length substantially equal to a width of the window, and having an outward-facing surface comprising a fastener material;

a second elongated strip comprising a first layer of curtain tape having a plurality of pockets configured to receive curtain hooks, a second layer of fastener material secured to the first layer, and an intermediate fabric layer disposed between the first and second layers, wherein the first layer, the intermediate fabric layer, and the second layer each have the same width, wherein the first and second layers have the same length, and wherein the intermediate fabric layer has a length greater than the length of the first and second layers such that opposite lengthwise end portions of the intermediate fabric layer extend beyond the first and second layers, thereby forming graspable tabs at opposing lengthwise ends of the second elongated strip;

wherein the second elongated strip is removably attachable to the first elongated strip by mating engagement of the fastener material of the second elongated strip with the fastener material of the first elongated strip;

a third elongated strip of curtain tape secured to a curtain;

wherein the curtain tape of the second elongated strip comprises a fabric strip and a plurality of adjacent, uniform pockets of fabric formed along the fabric strip, each of the pockets defining an interior cavity accessible from both a top edge and a bottom edge of the fabric strip, and configured to receive a portion of a curtain hook; and a plurality of curtain hooks disposed in the pockets of the curtain tape of the second elongated strip, the plurality of curtain hooks configured to engage the third elongated strip of curtain tape secured to the curtain, thereby suspending the curtain from the second elongated strip, and wherein pulling downward on at least one of the graspable tabs initiates a peel-direction disengagement of the second elongated strip from the first elongated strip along substantially the entire length thereof, thereby allowing tool-free removal of the curtain.

2. The window treatment attachment system of claim 1, wherein the fastener material comprises a touch fastener material.

3. The window treatment attachment system of claim 1, wherein the second layer of fastener material is sewn to the first layer of curtain tape.

4. The window treatment attachment system of claim 1, wherein the intermediate fabric layer extends continuously along the full length of the second elongated strip.

5. The window treatment attachment system of claim 1, wherein the intermediate fabric layer is sewn between the first layer of curtain tape and the second layer of fastener material.

6. The window treatment attachment system of claim 1, wherein the graspable tabs extend downwardly beyond opposite ends of the second elongated strip when installed.

7. The window treatment attachment system of claim 1, wherein the first elongated strip is configured for attachment to a ceiling using adhesive on an inward-facing surface.

8. The window treatment attachment system of claim 1, wherein the pockets of the curtain tape of the second elongated strip are configured to removably receive the plurality of curtain hooks such that the curtain hooks protrude outwardly for engagement with corresponding pockets in the curtain tape secured to the curtain.

9. The window treatment attachment system of claim 1, wherein the intermediate fabric layer comprises a woven fabric.

* * * * *